United States Patent [19]

Vogel et al.

[11] Patent Number: 4,507,528

[45] Date of Patent: Mar. 26, 1985

[54] PILOT LAMP

[76] Inventors: Ernst Vogel, Wiesenstr. 15, CH-4057 Basel, Switzerland; Fritz Berger, Hofacker 381, CH-4625 Oberbuchsiten, both of Switzerland

[21] Appl. No.: 439,641

[22] Filed: Nov. 5, 1982

[30] Foreign Application Priority Data

Nov. 5, 1981 [CH] Switzerland ..... 7082/81

[51] Int. Cl.[3] ..... H01H 13/06

[52] U.S. Cl. ..... 200/302.2; 200/314

[58] Field of Search ..... 200/314, 302, 304

[56] References Cited

U.S. PATENT DOCUMENTS

| | | | |
|---|---|---|---|
| 4,126,774 | 11/1978 | Gossling | 200/314 |
| 4,178,493 | 12/1979 | Sauer | 200/314 X |

FOREIGN PATENT DOCUMENTS

| | | | |
|---|---|---|---|
| 1290620 | 3/1969 | Fed. Rep. of Germany | 200/314 |
| 2914709 | 10/1980 | Fed. Rep. of Germany | 200/302 A |
| 1522558 | 4/1968 | France | 200/314 |
| 589635 | 1/1978 | U.S.S.R. | 200/302 A |

*Primary Examiner*—John W. Shepperd
*Assistant Examiner*—Renee S. Kidorf
*Attorney, Agent, or Firm*—Peter K. Kontler

[57] ABSTRACT

A pilot lamp wherein a light source and an axially reciprocable switching member are mounted in a housing supporting a switch which is actuatable by the switching member through the medium of a depressible actuator having a tubular section with a conical or pyramidal external surface which tapers in a direction toward the tip of the section and can expand the inner marginal portion of an annular membrane whose outer marginal portion is mounted in the housing. During insertion of the tubular section, its external surface expands the inner marginal portion of the membrane so that the latter sealingly engages the actuator while the actuator moves its section into engagement with the switching member. A shoulder on the switching member intercepts the inner marginal portion of the membrane during insertion of the tubular section to thereby ensure that such inner marginal portion expands during further insertion of the tubular section into the switching member. During extraction of the tubular section, e.g., to gain access to the light source, the membrane is prevented from leaving the housing by a ring which sealingly urges the outer marginal portion against an inclined internal surface of the housing and is held in the housing by a detent mechanism.

20 Claims, 3 Drawing Figures

PILOT LAMP

BACKGROUND OF THE INVENTION

The present invention relates to signal lamps, e.g., to pilot lamps which can indicate the condition of one or more electric switches or the like. More particularly, the invention relates to improvements in pilot lamps or signal lamps (hereinafter called signal lamps) which are intended or are likely to be utilized under circumstances where water or another liquid tends to penetrate into their interior and, in the absence of appropriate precautionary measures, interfere with proper operation of the lamp by short-circuiting the conductor means connecting the light source or sources with a source of electrical energy.

It is already known to provide a signal lamp with a depressible actuator for one or more switches. The actuator has a tubular section which can cooperate with a mobile switching member in the interior of a housing member. A membrane is interposed between the housing member and the tubular section of the actuator to prevent penetration of liquids or solid contaminants into the interior of the lamp, especially into the space or spaces accommodating the electric conductor means. Reference may be had, for example, to German Offenlegungsschrift No. 29 14 709 which discloses a signal lamp of the just outlined character. The tubular section of the actuator has a cylindrical external surface which is form-lockingly engaged by the inner marginal portion of the membrane. The outer marginal portion of the membrane is caused to sealingly surround and to thus form-lockingly engage a clamping ring. Once the actuator is inserted into the housing member, the clamping ring urges the outer marginal portion of the membrane against a portion of the housing member. The external surface of the tubular section of the actuator has projections which serve to push the clamping ring into the housing member during insertion of the actuator, and to extract the clamping ring from the housing member in response to separation of the tubular section from the switching member.

A drawback of the just discussed conventional signal lamp is that the clamping ring and the outer marginal portion of the membrane are detachable from the housing member, i.e., that such parts become fully separated from the housing member when the actuator is extracted for the purpose of gaining access to the light source or for any other reason. The detached membrane is likely to be contaminated and/or damaged while the tubular section of the actuator is separated from the switching member.

OBJECTS AND SUMMARY OF THE INVENTION

An object of the invention is to provide a signal lamp which is constructed and assembled in such a way that its sealing means, especially a deformable diaphragm, is less likely to be contaminated and/or damaged than in heretofore known lamps.

An other object of the invention is to provide a signal lamp wherein the sealing means can be permanently or substantially permanently installed in the housing member.

A further object of the invention is to provide a signal lamp wherein the actuator contributes to the establishment of a highly satisfactory sealing action as a result of its movement into requisite engagement with the housing member and/or with a part which is installed in or on the housing member.

An additional object of the invention is to provide a novel and improved method of sealing the light source or light sources of a signal lamp from external influences, especially from droplets of water or another liquid.

Still another object of the invention is to provide a signal lamp which is at least as compact and at least as simple as heretofore known signal lamps even though its ability to prevent entry of foreign matter and to protect the membrane is superior to that of conventional devices.

A further object of the invention is to provide a signal lamp wherein the membrane is compelled to properly seal the interior of the housing member from the surrounding atmosphere in automatic response to proper attachment of the actuator to the switching member.

An additional object of the invention is to provide a signal lamp which can be used as a superior substitute for existing signal lamps.

Another object of the invention is to provide the signal lamp with novel and improved means for securing the membrane to the housing member.

The invention is embodied in a signal lamp (e.g., a pilot lamp or another indicator lamp) which comprises a housing member, a switching member in the housing member, a mobile actuator having an end portion and a conical or pyramidal external surface which tapers in a direction toward the end portion, and an annular membrane having a first marginal portion mounted in the housing member, a deformable second marginal portion defining a passage whose cross-sectional area in undeformed condition of the second marginal portion exceeds the cross-sectional area of the external surface in the region of the end portion of the actuator, and preferably an undulate flexible intermediate portion between the two marginal portions. The actuator is movable between a detached first position and a depressed second position of engagement with the switching member to thereby advance its end portion through and beyond the passage during movement to the second position whereby the external surface sealingly engages and tends to entrain the second marginal portion of the membrane. One of the aforementioned members has stop means which is located in the path of movement of the second marginal portion of the membrane with the external surface of the actuator and enables the external surface to move relative to and to expand the second marginal portion during movement of the actuator to its second position.

The actuator preferably comprises a tubular section which includes the aforementioned end portion; the external surface is provided on such tubular section of the actuator, and the actuator preferably constitutes a means for moving the switching member relative to the housing member, e.g., by depressing the actuator once the latter assumes its second position so that such depression entails simultaneous movement of the actuator and of the switching member relative to the housing member. The switching member surrounds and engages a part of the tubular section in the second position of the actuator.

The diameter of the first marginal portion of the membrane preferably exceeds the diameter of the second marginal portion.

The stop means can include a shoulder provided on the switching member. For example, the switching member can comprise an annular or tubular portion having an end face which can constitute the just mentioned shoulder.

The lamp further comprises means for sealingly securing the first marginal portion of the membrane to the housing member. Such securing means can comprise a clamping ring and detent means for coupling the ring to the housing member. For example, the ring can have a substantially U-shaped cross-sectional outline and can include a first portion or leg engaging the first marginal portion of the membrane and a second portion or leg which cooperates with the detent means. The detent means can be provided in and can constitute an integral part of the housing member. The first portion or leg of the ring is preferably arranged to maintain the first marginal portion of the membrane in sealing engagement with an internal surface of the housing member, preferably with a substantially conical internal surface. Such internal surface can taper in a direction toward a switch which is actuatable by the switching member.

The membrane preferably surrounds a light source in the interior of the housing member, and such light source can comprise a bulb whose envelope is at least substantially coaxial with the membrane. The aforementioned section of the actuator can constitute or comprise a reflector for the light issuing from the aforementioned light source. The internal surface of the preferably tubular section of the actuator can constitute the reflector, and such internal surface of the tubular section preferably tapers, at least in part, toward the aforementioned end portion of the actuator.

The novel features which are considered as characteristic of the invention are set forth in particular in the appended claims. The improved lamp itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
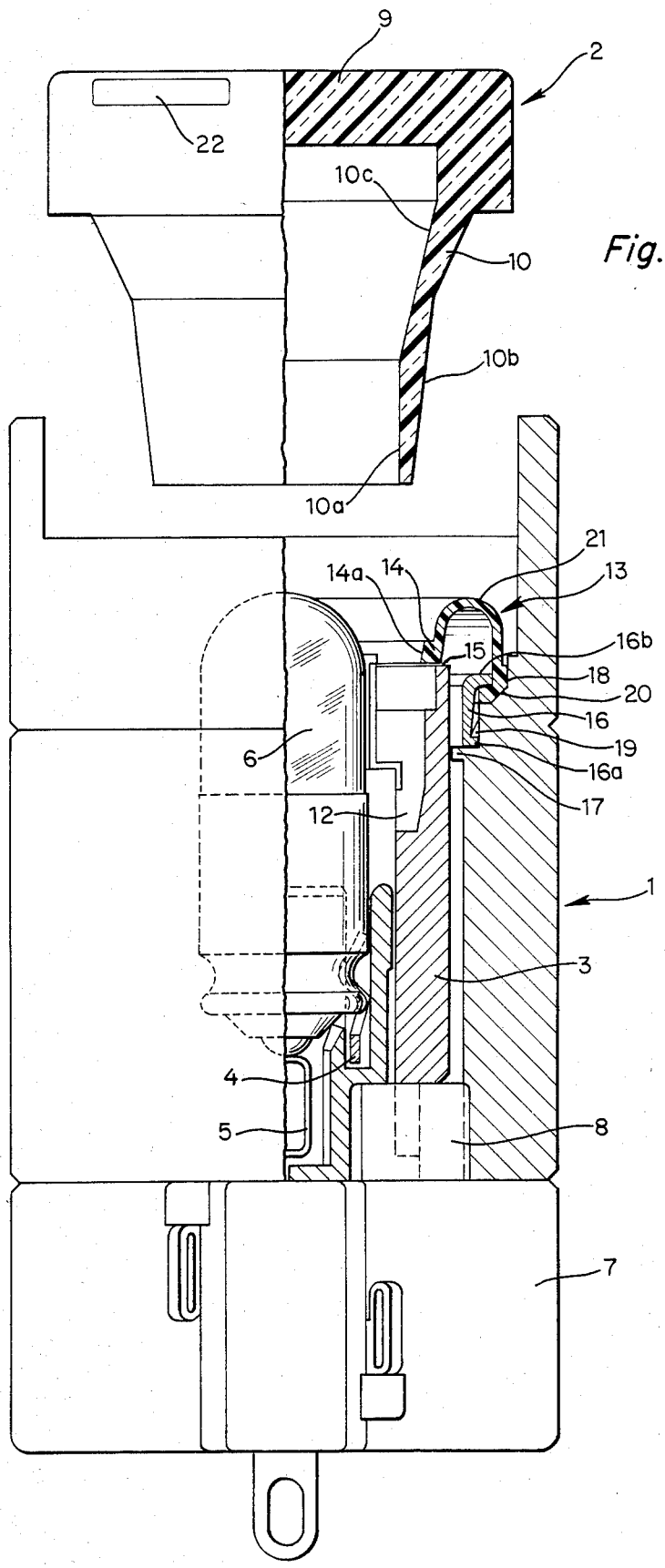
FIG. 1 is a partly elevational and partly central sectional view of a signal lamp which embodies the invention, the actuator being shown in its detached position.

The signal lamp which is shown in the drawing comprises a housing member 1 confining a reciprocable tubular or sleeve-like switching member 3 and adapted to receive a cupped actuator 2 having a tubular section 10 which is insertable into the switching member 3. The housing member 1 further accommodates electrical conductors 4, 5 which connect an energy source (not specifically shown) with a light source 6 here shown as a bulb having an elongated tubular envelope which is coaxial or substantially coaxial with the switching member 3, with the (properly inserted) actuator 2 and with an annular membrane 13 which is in permanent sealing engagement with the housing member 1 and sealingly engages the tubular section 10 when the actuator 2 assumes the position of FIG. 2 or 3, namely a position of engagement with the switching member 3. The housing member 1 further supports one or more signal transmitting switches 7 which can be actuated by the switching member 3 in response to depression of the actuator 2 to the position shown in FIG. 3. The switching member 3 then depresses or otherwise displaces one or more trips 8 for the switch or switches 7 in or on the housing 1.

Figure 2:
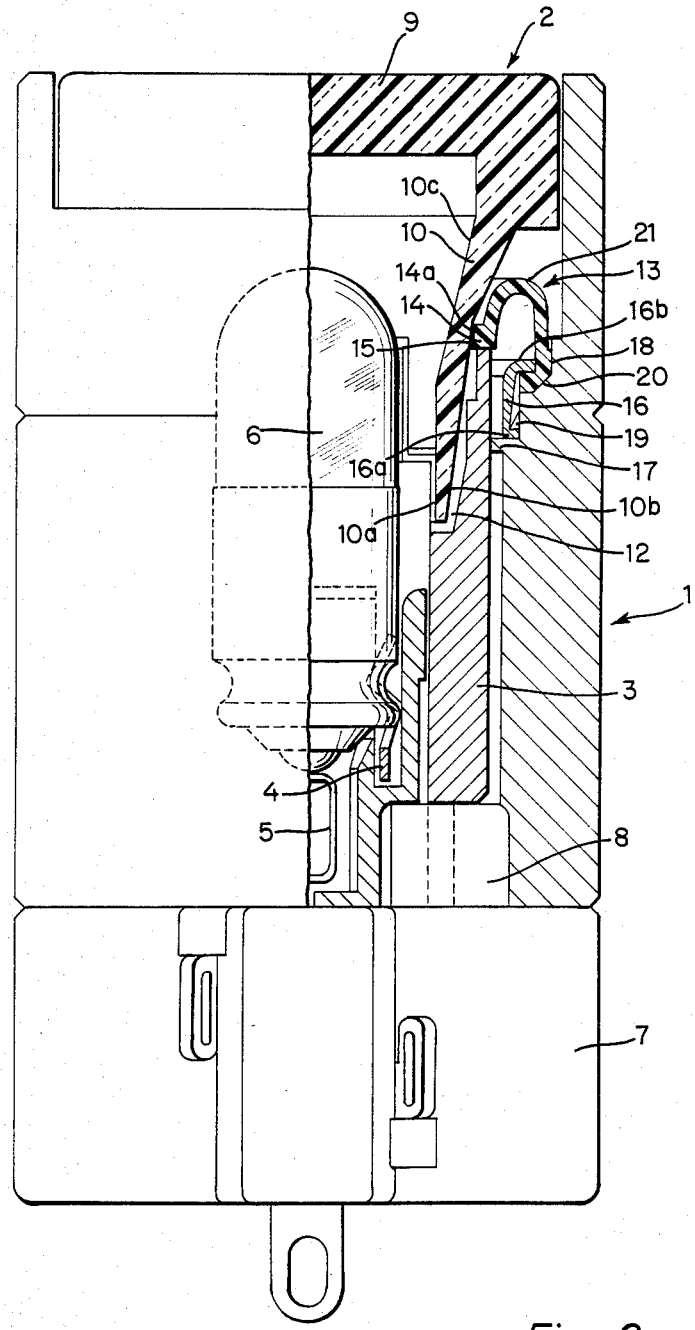
FIG. 2 is a partly elevational and partly central sectional view of the signal lamp in an attaching position.

The actuator 2 comprises a light-transmitting plate-like cover 9 located in front of the light source 6 and serving as a closure for the outer end portion of the tubular section 10. The external surface **10*b* of the section 10 resembles or constitutes a conical or pyramidal frustum and tapers in a direction toward the inner end portion 10*a* of the part 10. The internal surface 10*c* of the tubular section 10 tapers in the same direction as the external surface 10*b*, and at least a portion of such internal surface can constitute a reflector for light which issues from the source 6 and penetrates through the light-transmitting cover 9. The diameter or cross-sectional area of the internal surface 10*c* can increase all the way or close to the inner side of the cover 9. The configuration of the internal surface 10*c* of the tubular section 10 is preferably such that the cover 9 is fully illuminated by light issuing from the source 6 in that axial position of the actuator 2 which is shown in FIG. 2 as well as in the position of FIG. 3 in which the actuator 2 is depressed to move the switching member 3 axially of the housing member 1 and to thereby activate or deactivate the switch or switches 7 via trip or trips 8. The tapering external surface 10*b* of the tubular section 10 is in frictional engagement with the internal surface of the sleeve-like switching member 3 when the section 10 assumes the position of FIG. 2 or 3. The end portion 10*a* of the section 10 is then received in an annular socket 12 of the switching member 3. One or more coil springs or other suitable biasing means of conventional design (not specifically shown) are installed in the housing member 1 to yieldably oppose the movement of the switching member 3 relative to the housing member in a direction to actuate the switch or switches 7 through the medium of the trip or trips 8 in response to depression of the actuator 2 to the position of FIG. 2 or 3**.

The aforementioned annular membrane 13 has a first or outer marginal portion 18 which is permanently or substantially permanently mounted in the housing member 1, and a second or inner marginal portion 14 which can come into sealing engagement with the tapering external surface **10*b* of the tubular section 10. The median portion 21 of the membrane 13 is of undulate shape and can flex so as to enable the inner marginal portion 14 to share some of the axial movements performed by the tubular section 10 relative to the switching member 3. The membrane 13 can consist of rubber or another suitable elastomeric material, and its marginal portions 14 and 18 are preferably provided with reinforcing beads. When the tubular section 10 of the actuator 2 is fully inserted so that it assumes the position of FIG. 2 or 3, the beaded inner marginal portion 14 of the membrane 13 abuts against a stop in the form of an annular shoulder constituting the upper end face 15 of the axially reciprocable sleeve-like switching member 3**.

The means for sealingly securing the beaded outer marginal portion 18 of the membrane 13 to the housing member 1 comprises a mounting means including a sealing ring 16 having a substantially U-shaped cross-sectional outline with a shorter inner portion or leg 16*a* which engages with a detent structure 19 forming a separable or integral part of the housing member 1, and with a longer outer portion or leg 16*b* which urges the marginal portion 18 against a tapering conical internal surface 20 of the housing member 1. The web of the clamping or sealing ring 16 is substantially coaxial with the switching member 3 and tubular section 10. The inner portion or leg 16*a* of the ring 16 abuts against an internal protuberance (e.g., a circumferentially complete rib) 17 of the housing member 1. As can be readily seen in the drawing, the marginal portion 18 of the membrane 13 surrounds the portion or leg 16*b* of the ring 16 and is urged against the aforementioned tapering internal surface 20 of the housing member 1. This internal surface tapers in a direction toward the interior of the housing member 1, i.e., toward the external surface of the switching member 3 and in a direction toward the socket 12. The detent structure 19 can include one or more inwardly extending claws or teeth which overlie the leg 16*a* so that the latter cannot be extracted from the housing member 1 in response to extraction of the actuator 2 from the switching member 3. The reference character 14*a* denotes a passage which is defined by the beaded inner marginal portion 14 of the membrane 13 and whose cross-sectional area, in undeformed condition of the marginal portion 14, is greater than the cross-sectional area of the external surface 10*b* in the region of the end portion 10*a* of the tubular section 10.

In assembling the signal lamp, the membrane 13 is inserted into the housing member 1 while its beaded outer marginal portion 18 surrounds the leg 16*b* of the ring 16. The leg 16*a* of the ring 16 snaps behind the tooth or teeth of the detent structure 19 so that the leg 16*a* is held against uncontrolled or unintentional movement away from the collar 17 of the housing member 1*a*. The switching member 3 can be inserted ahead of or subsequent to insertion of the parts 13, 16 and the actuator 2 is inserted thereafter so that the end portion 10*a* of its tubular section 10 advances through and beyond the passage 14*a* before the external surface 10*b* engages and urges the marginal portion 14 against the shoulder or stop 15 of the switching member 3. The shoulder 15 prevents the marginal portion 14 from participating in each and every stage of movement of the actuator 2 to the position of FIG. 2, i.e., the marginal portion 14 can participate in such movement only during that stage when the external surface 10*b* of the section 10 comes into engagement with the marginal portion 14 and moves the latter against the shoulder 15; from there on, the section 10 moves relative to the marginal portion 14 and the latter is expanded as a result of engagement with successive portions of the external surface 10*b* whereby the membrane 13 ensures the establishment of a highly satisfactory sealing action in the space between the internal surface 20 of the housing member 1 and the external surface 10*b* of the tubular section 10 not later than at the time when the actuator 2 assumes the position of FIG. 2. The inward movement of the actuator 2 is terminated (see FIG. 3) when the end portion 10*a* enters the socket 12 and the external surface 10*b* moves into requisite frictional engagement with the internal surface of the switching member 3 at a locus which is located inwardly of the beaded inner marginal portion 14 of the membrane 13. It has been found that the improved signal lamp reliably prevents penetration of droplets of water or another liquid into the space for the light source 6 and its conductors 4, 5 as soon as the actuator 2 is properly inserted into the housing member 1 and as long as the detent structure 19 holds the leg 16*a* of the ring 16 against movement axially and away from the collar 17 of the housing member.

As also shown in the drawing, the membrane 13 and the ring 16 can be located at the level of a portion of the light source 6. At least that portion of the internal surface 10*c* of the tubular section 10 which is located outwardly of the ring 16 and membrane 13, as considered in the axial direction of the light source, is preferably a conical frustum and constitutes the aforementioned reflector for the light issuing from the source 6 and propagating itself outwardly through the cover 9 of the actuator 2.

If the actuator 2 is to be extracted from the housing member 1, e.g., in order to gain access to the light source 6, the actuator is engaged at the exterior of its cover 9 and is pulled upwardly, as viewed in the drawing (note the notch 22), whereby the end portion 10*b* leaves the socket 12 and the inner marginal portion 14 of the membrane 13 moves with the external surface 10*b* of the tubular section 10 to the extent permitted by the undulate portion 21. Once the portion 21 is taut, the external surface 10*b* begins to slide in the passage 14*a* because the ring 16 holds the outer marginal portion 18 against axial movement relative to the housing member 1.

Figure 3:
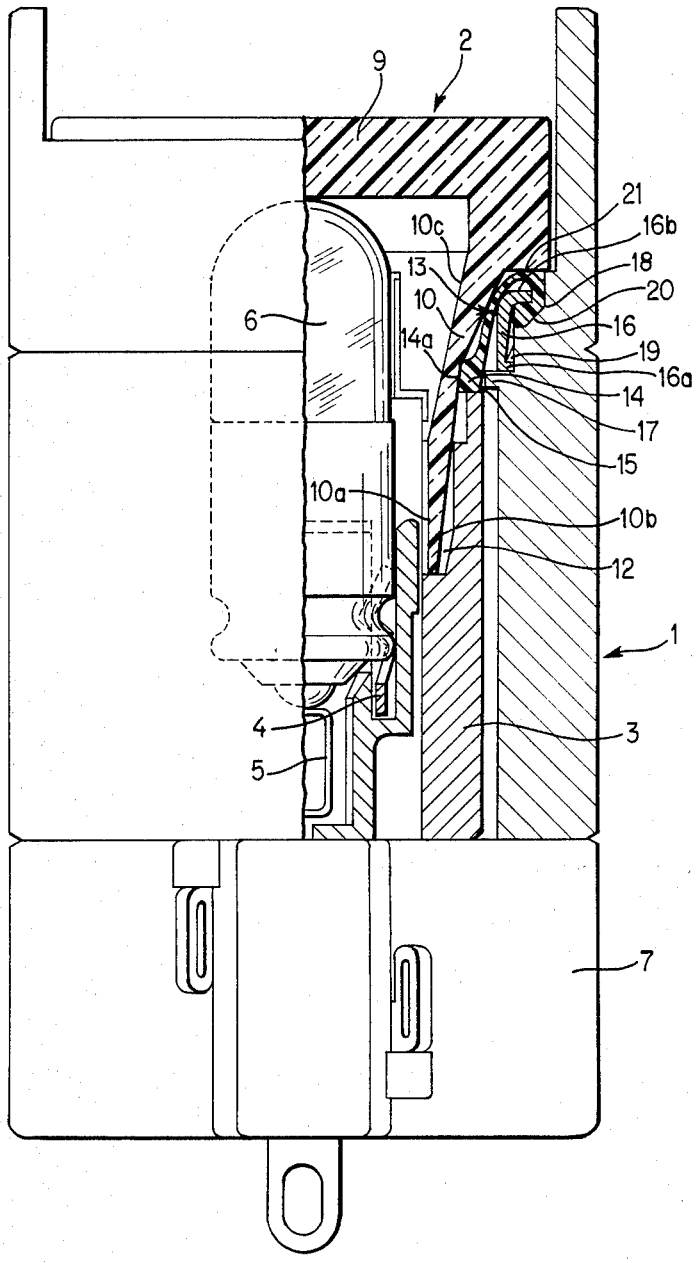
FIG. 3 is a partly elevational and partly central sectional view of the signal lamp in a fully attached position.

Another advantage of the partly or fully conical or pyramidal tubular section 10 is that the inner end portion 10*a* can be located close to the light source 6 (as considered in the radial direction of the parts 6, 10 and 3) when the actuator 2 is fully inserted to assume the position of FIG. 3. This is desirable and advantageous because it contributes to compactness of the signal lamp without interfering with adequate illumination of the cover 9 in each axial position of the parts 3 and 10 relative to the housing member 1. Proper illumination of the cover 9 is important because this enables the operator to reliably detect the condition of the switch or switches 7. The arrangement may be such that the light source 6 emits light in response to alternate depressions of the switching member 3.

The aforediscussed mode of sealingly securing the outer marginal portion 18 of the membrane 13 to the housing member 1 by the ring 16 also contributes to compactness of the signal lamp. For example, the dimensions of the housing member 1 may be selected in such a way that they match the standard dimensions (18×18 mm). Thus, the improved signal lamp can be used as a superior substitute for heretofore known pilot lamps or the like.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A signal lamp, comprising a housing member; a switching member in said housing member; a mobile actuator having an end portion and an external surface tapering toward said end portion; and an annular membrane having a first marginal portion mounted on mounting means in said housing member and a deformable second marginal portion defining a passage whose cross-sectional area in undeformed condition of said second marginal portion exceeds the cross-sectional area of said external surface in the region of said end portion but is less than the maximum cross-sectional area of said external surface, said actuator being movable between a detached position and an attached position of engagement with said switching member to thereby advance said end portion through and beyond said passage during movement to said attached position whereby said external surface sealingly engages and tends to entrain said second marginal portion during further movement of said actuator toward engagement with said switching member, said switching member having stop means located in the path of movement of said second marginal portion entrained by said external surface of said actuator and enabling said external surface to move relative to and expand said second marginal portion during movement of said actuator to said attached position.

2. The lamp of claim 1, wherein said actuator comprises a tubular section including said end portion, said external surface being provided on said tubular section.

3. The lamp of claim 1, wherein said switching member is movable relative to said housing member through the medium of said actuator.

4. The lamp of claim 1, wherein said first marginal portion has a diameter which exceeds the diameter of the second marginal portion of said membrane.

5. The lamp of claim 1, wherein said actuator comprises a tubular section including said end portion, said external surface being provided on said tubular section and said switching member surrounding and engaging a part of said section in the attached position of said actuator.

6. The lamp of claim 5, wherein said stop means includes a shoulder provided on said switching member.

7. The lamp of claim 6, wherein said switching member includes an annular portion having an end face which constitutes said shoulder.

8. The lamp of claim 1, wherein said mounting means comprises means for sealingly securing the first marginal portion of said membrane to said housing member.

9. The lamp of claim 8, wherein said securing means comprises a clamping ring and detent means coupling said ring to said housing member.

10. The lamp of claim 9, wherein said ring has a substantially U-shaped cross-sectional outline and includes a first portion engaging said first marginal portion and a second portion cooperating with said detent means.

11. The lamp of claim 10, wherein said detent means is provided in said housing member.

12. The lamp of claim 10, wherein said housing member has an internal surface and said first portion of said ring is arranged to maintain said first marginal portion in sealing engagement with the internal surface of said housing member.

13. The lamp of claim 12, wherein said internal surface is a substantially conical surface.

14. The lamp of claim 13, further comprising a switch actuatable by said switching member and provided on said housing member, the diameter of said internal surface decreasing in a direction toward said switch.

15. The lamp of claim 1, further comprising a light source in said housing member, said membrane surrounding said light source.

16. The lamp of claim 15, wherein said light source is at least substantially coaxial with said membrane.

17. The lamp of claim 1, further comprising a light source in said housing member, said actuator including a section constituting a reflector for the light issuing from said source.

18. The lamp of claim 17, wherein said section is a tube having an internal surface at least a portion of which constitutes said reflector.

19. The lamp of claim 18, wherein said internal surface tapers in a direction toward the end portion of said actuator, said external surface and said end portion being provided on said section.

20. The lamp of claim 1, wherein said membrane includes an undulate flexible intermediate portion between said marginal portions thereof.

* * * * *